US005694295A

United States Patent [19]

Mochizuki et al.

[11] Patent Number: 5,694,295

[45] Date of Patent: Dec. 2, 1997

[54] HEAT PIPE AND PROCESS FOR MANUFACTURING THE SAME

[75] Inventors: Masataka Mochizuki; Motoyuki Ono; Koichi Mashiko; Yuji Saito; Masashi Hasegawa; Masakatsu Nagata, all of Tokyo, Japan

[73] Assignee: Fujikura Ltd., Tokyo, Japan

[21] Appl. No.: 638,537

[22] Filed: Apr. 26, 1996

[30] Foreign Application Priority Data

May 30, 1995 [JP] Japan ..... 7-155309
Dec. 1, 1995 [JP] Japan ..... 7-338270

[51] Int. Cl.[6] ..... H05K 7/20

[52] U.S. Cl. ..... 361/699; 165/80.3; 165/104.22; 165/104.33; 174/15.2; 361/704

[58] Field of Search ..... 62/259.2; 165/80.2–80.4, 165/104.21, 104.22, 104.26, 104.27, 104.33; 174/15.2; 257/714, 715; 361/698, 699–704, 717–718, 722

[56] References Cited

U.S. PATENT DOCUMENTS 4,012,770 3/1977 Pravda et al. ..... 165/80.4
4,842,053 6/1989 Yatsuhashi et al. ..... 165/104.14
5,198,889 3/1993 Hisano et al. ..... 361/701
5,216,580 6/1993 Davidson et al. ..... 361/385
5,309,986 5/1994 Itoh ..... 165/104.33
5,390,077 2/1995 Paterson ..... 361/700
5,529,115 6/1996 Paterson ..... 361/700

FOREIGN PATENT DOCUMENTS 7-142652 6/1995 Japan .

*Primary Examiner*—Gregory D. Thompson
*Attorney, Agent, or Firm*—Oblon, Spivak, McClelland, Maier & Neustadt, P.C.

[57] ABSTRACT

A heat pipe for transferring heat as the latent heat of evaporation to a radiating portion at a lower temperature by heating a heating portion of a container to evaporate a working fluid and by conveying the produced vapor to the radiating portion thereby to condense the vapor. The container is formed into a flattened hollow shape by: a flat heating portion; a radiating portion opposed at a distance to the heating portion and having a larger area than that of the heating portion; and side wall portions jointing the heating portion and the radiating portion to each other along the entire peripheral edge portions of the same.

14 Claims, 13 Drawing Sheets

HEAT PIPE AND PROCESS FOR MANUFACTURING THE SAME

BACKGROUND OF THE INVENTION

1. Field of the Invention

The present invention relates to a heat pipe, which is suited for cooling a small-sized heating member having a flat portion and which is excellent in heat transfer efficiency, and a process for manufacturing the heat pipe.

2. Related Art

In the field of a computer for personal use (as will be called the "personal computer") of recent years, there widely spreads the so-called "portable type personal computer" such as the notebook type or the sub-notebook type. The personal computer of this kind aims at the portability as its main object and is earnestly desired to have a smaller size and a lighter weight so that its internal space to be occupied by a cooling space is naturally restricted to an extremely small one. In accordance with improvements in the multi-function and the processing rate, on the other hand, the output of a processor increases year by year so that the heat to be generated by the processor accordingly increases. In the prior art, therefore, a heat pipe having an excellent heat transferability is used as the cooling device.

FIG. 35 shows an example of the heat pipe for a personal computer, as disclosed in "Practical Heat Pipe" (issued by Nikkan Kogyo Shinbun) distributed in Japan on Oct. 25, 1985. This heat pipe 1 is the so-called "flat heat pipe", the container of which is formed into a rectangular section to provide a heating portion 1*a* at its lower face and a radiating portion 1*b* at its upper face, as shown. This radiating portion 1*b* is provided at its outside with a number of radiating fins 1*c*. Moreover, the inside of the container is evacuated to a vacuum and is then filled up with a predetermined amount of condensable working fluid 3 such as water.

In a predetermined portion of the circuit which is formed on a printed-circuit board 4, on the other hand, there is mounted a central processing unit (as will be shortly referred to as the "CPU") 2, on the upper face of which the heating portion 1*a* of the heat pipe 1 is mounted in close contact.

In this heat pipe 1, moreover, when the CPU 2 is caused to generate heat with the circuit being electrically energized, the temperature of the heating portion 1*a* is raised by the heat. Then, the confined working fluid 3 is heated and vaporized until the resultant vapor moves upward and condenses at the radiating portion 1*b* at a lower temperature. In other words, the heat, as transferred as the latent heat of vapor of the working fluid 3, is released to the atmosphere from the radiating fins 1*c* which are disposed at the outside of the radiating portion 1*b*.

As a result, the heat can be efficiently released if the radiating fins 1*c* are caused to face the passage of the cooling wind which is generated by the (not-shown) cooling fan disposed in the casing of the personal computer.

By thus using the heat pipe 1 for cooling the CPU 2, much heat can be transferred in the latent state of vapor so that the CPU 2 can be effectively cooled down. As a result, it is possible to prevent the inoperability and depression of the personal computer, as might otherwise be caused by the overheat of the CPU 2.

According to the conventional heat pipe 1, as described above, the cooling efficiency of the CPU 2 can be improved not only because its substantial heat conductivity is extremely high but also because its wide area directly contacts the CPU 2 or the heat source. Since the container is a hollow body having a rectangular section, however, the heat pipe 1 can take a wide contact area with the CPU 2, but its radiating portion 1*b* has a relatively small area.

Specifically, the working fluid 3 is liquid in the heating portion 1*a*, and it may be sufficient that the heating portion 1*a* has an area substantially equal to that of the upper face of the CPU 2. At the radiating portion 1*b*, on the contrary, the working fluid 3 is vapor to have an extremely expanded volume. With the conventional heat pipe 1 in which the radiating portion 1*b* and the heating portion 1*a* have an equal area, however, the area of the radiating portion 1*b* to be directly contacted by the vapor of the working fluid 3 is so relatively short as to reduce the heat radiation. Thus, there arises a disadvantage that the substantial cooling capacity is restricted.

In addition, the flat type heat pipe described above is not equipped with any means for conveying the working fluid 3 in liquid phase from the upper face to the bottom face of the inside of the container. As a result, the working fluid 3 in liquid phase cannot be fed to the heating portion 1*a* so that the heat pipe 1 is left inoperative, when the CPU 2 is positioned above the heat pipe 1. This arrangement effects no cooling action. In other words, the flat type heat pipe has a disadvantage that it cannot operate in the so-called "top heat mode".

SUMMARY OF THE INVENTION

The present invention has been conceived on the basis of the technical background thus far described and has a main object to provide a heat pipe which can effect the heat transfer efficiently from a local heat source and can operate even in the top heat mode.

Another object of the present invention is to provide a process for manufacturing the above-specified heat pipe in large quantities at a reasonable cost and at a high rate.

According to the present invention, therefore, there is provided a heat pipe which comprises a container formed into a flattened hollow shape by: a flat heating portion; a radiating portion opposed at a distance to the heating portion and having a larger area than that of the heating portion; and side wall portions jointing the heating portion and the radiating portion to each other along the entire peripheral edge portions of the same.

In the heat pipe of the present invention, a working fluid, as confined in the container, will evaporate when the heating portion of the container is heated. This working fluid vapor flows to the radiating portion under a lower internal pressure until it has its heat lost on the inner face of the radiating portion to condense. In other words, the heat is dissipated to the outside from the outer face of the radiating portion. In this case, much vapor contacts the inner face of the radiating portion because a condensing portion has a larger area than that of the evaporating portion, so that the amount of the working fluid vapor to release the heat and to condense will increase. According to the present invention, therefore, it is possible to provide a heat pipe having a high heat transferability.

In the heat pipe of the present invention, moreover, there can be arranged between the inner face of the heating portion and the inner face of the radiating portion columnshaped wicks for transferring the working fluid in liquid phase by the capillarity pressure. In the present invention, still moreover, a porous spray coating can be formed on the inner face of the container.

With the aforementioned wicks, most of the working fluid in liquid phase, as has wetted the inner face of the radiating portion, is conveyed to the inner face of the heating portion directly not along the inner faces of the sloped side walls by the capillarity pressure of the wicks. As a result, a necessary amount of working fluid in liquid phase is fed without fail to the inner face of the heating portion acting as the evaporating portion no matter whether it might be in the bottom heat mode, in which the heating portion is arranged below the radiating portion, or in the top heat mode in which the heating portion is arranged above the radiating portion.

In the top heat mode, for example, the working fluid in liquid phase is distributed and held over a wide range of the heating portion by the capillarity pressure which is established in the spray coating. In other words, the working fluid is so held by the spray coating that it will not drop. As a result, the evaporation/condensation cycle of the working fluid in the top heat mode is vigorously effected.

In the process for manufacturing the heat pipe according to the present invention, on the other hand, a plastically deformable pipe material is formed at first into a flattened hollow shape by pressing the same in a radial direction thereof, and the two open end portions of the flattened pipe material are then closed. A container is prepared by forming an injection port for the working fluid at one of the open end portions, and a heat pipe is formed by confining a condensable fluid as the working fluid in the evacuated container. Then, the heat pipe container is accommodated in the cavity having a predetermined internal shape and is heated as it is. Specifically, the internal pressure of the container is raised to press the container from its inside in all directions. Then, the outer wall of the container is forced into contact with the inner wall of the cavity so that the container is formed after a predetermined internal shape of the cavity. In this case, the container is formed by making use of the pressure of the working fluid after the heat pipe has been made, so that the heat pipe having an enlarged radiating portion can be manufactured efficiently at the reduced steps.

The above and further objects and novel features of the invention will more fully appear from the following detailed description when the same is read with reference to the accompanying drawings. It is to be expressly understood, however, that the drawings are for purpose of illustration only and are not intended as a definition of the limits of the invention.

DETAILED DESCRIPTION OF THE PREFERRED EMBODIMENTS

Figure 1:
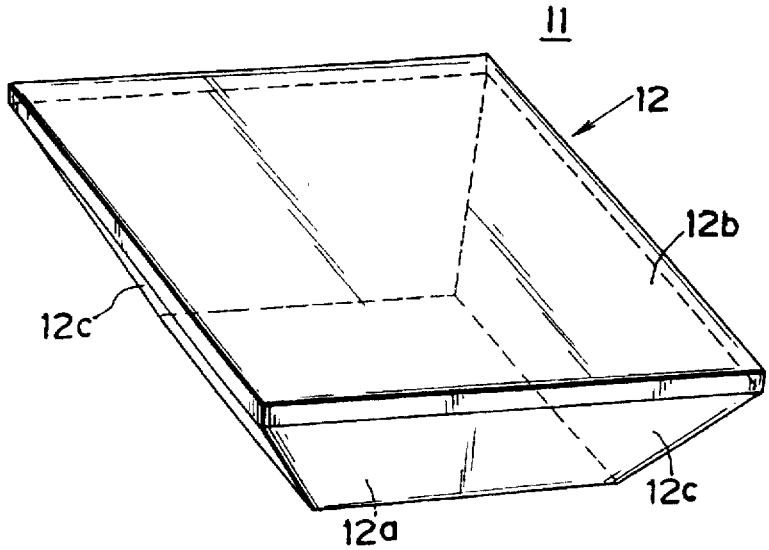
FIG. 1 is a perspective view showing a heat pipe according to one embodiment of the present invention.
Figure 2:
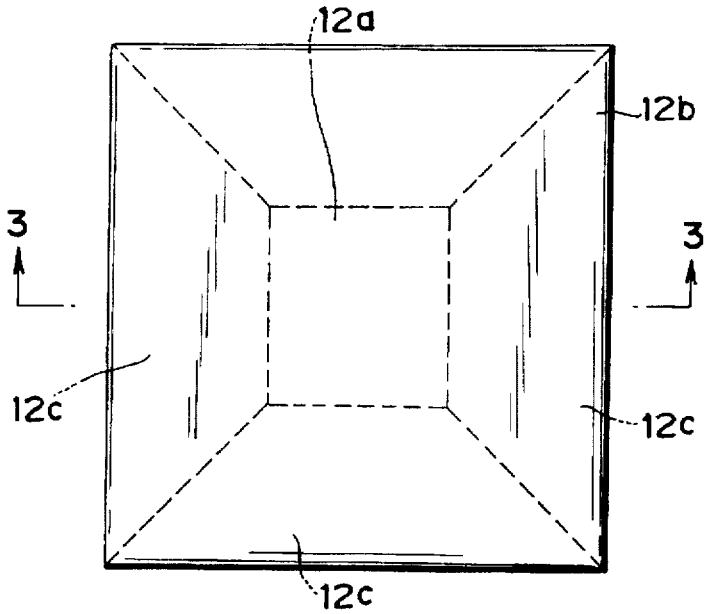
FIG. 2 is a top plan view of the same.
Figure 3:
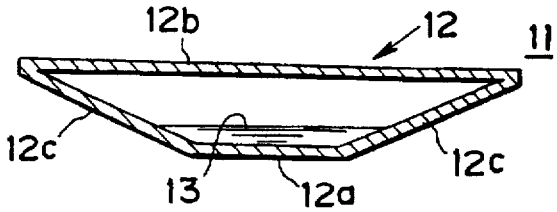
FIG. 3 is a section taken along line 3—3 of FIG. 2.

The present invention will be described in detail in connection with its embodiments. FIGS. 1 to 5 show one embodiment of the present invention. In a heat pipe 11, as shown, a container 12 is formed generally into a hollow frustum of quadrangular pyramid having a small height, as shown in FIGS. 1 to 3.

More specifically, this container 12 is a sealed container made of a metal such as copper and constructed to include: a generally square heating portion 12*a* having a side of about 30 mm; a generally square radiating portion 12*b* having a side of about 60 mm to have an area about four times as large as that of the heating portion 12*a* and arranged above and in parallel with the heating portion 12*a* at a spacing about 5 mm; and four sloped side wall portions 12*c* jointing the four sides of the radiating portion 12*b* and the corresponding four sides of the heating portion 12*a*. Moreover, this container 12 is filled with a predetermined amount of a condensable fluid such as pure water or alcohol as a working fluid 13. Here, the heating portion 12*a* is given a size and a shape substantially identical to those of the upper face of a later-described CPU 16.

Figure 4:
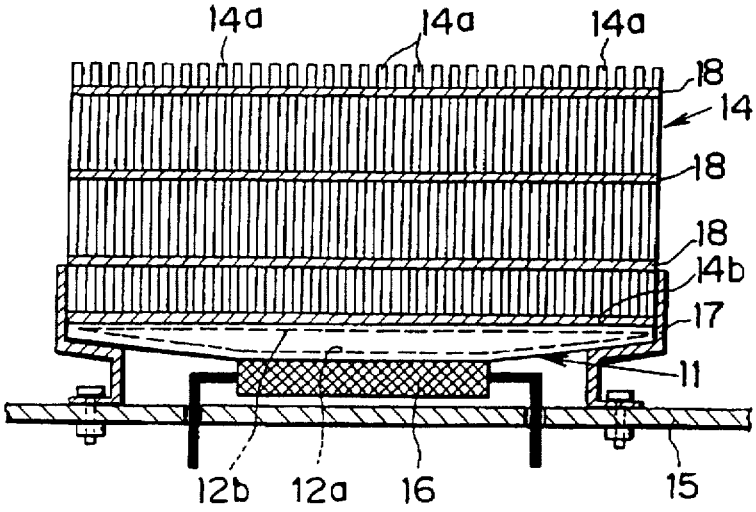
FIG. 4 is a front elevation showing the state in which the heat pipe is mounted in a bottom heat mode on a CPU.
Figure 5:
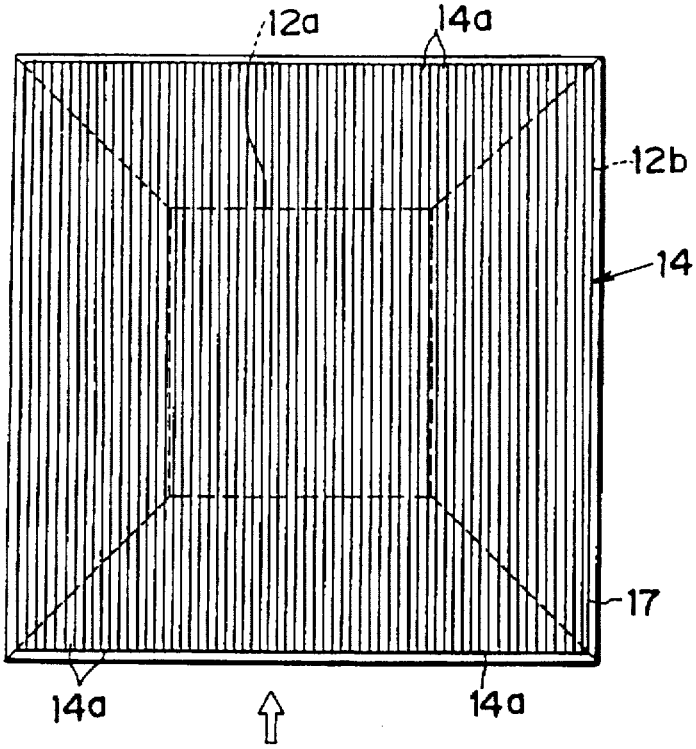
FIG. 5 is a top plan view of the heat pipe shown in FIG. 4.

As shown in FIGS. 4 and 5, on the other hand, a heat sink 14 is jointed integrally in a heat-transferable manner to the radiating portion 12*b* or the upper side of the heat pipe 11. Specifically, this heat sink 14 is manufactured by arraying a number of radiating fins 14*a* made of an aluminum sheet having a thickness of about 0.6 mm in parallel and at a narrow gap (e.g., a pitch of about 1.0 mm), and by integrating or welding the lower ends of those individual radiating fins 14*a* to a base plate 14*b* made of aluminum. This base plate 14*b* is mounted on the heating portion 12*b*.

On the other hand, the CPU 16 is mounted in a predetermined position of the (not-shown) printed circuit which is formed over a printed-circuit board 15 in a personal computer. On the upper face of the CPU 16, there is fixed the heating portion 12*a* of the heat pipe 11 in close contact. As a result, the heat pipe 11 is held in a bottom heat mode. Moreover, the joint portions between the heat pipe 11 and the heat sink 14 are fixed therearound by a holder 17 which is mounted on the printed-circuit board 15. In short, the heat pipe 11 and the heat sink 14 are held by the holder 17.

Incidentally, reference numeral 18 appearing in FIG. 4 designates three stages of current plates which partition the heat sink 14 vertically into a plurality of compartments for guiding the air flow horizontally between the radiating fins 14*a*.

Here will be described the operations of the heat pipe 11. As the CPU 16 is caused to generate heat by the power supply for operating the personal computer, the heat is transferred to the heating portion 12*a* of the heat pipe 11. Then, the working fluid 13, as reserved in the bottom of the container 12, is heated to evaporate. As a result, the inner face of the heating portion 12*a* provides the evaporating portion. The working fluid 13 thus evaporated flows toward the radiating portion 12*b* under a lower internal pressure so that it is cooled to condense by the inner face of the radiating portion 12*b*. As a result, the inner face of the radiating portion 12*b* provides the condensing portion. In other words, the vapor of the working fluid 13 transfers the heat generated by the CPU 16 as the latent heat of evaporation, and this heat is evolved when the working fluid 13 condenses at the radiating portion 12*b*. The heat thus evolved is transferred from the radiating portion 12*b* to the individual radiating fins 14*a* of the heat sink 14 until it is radiated from the individual radiating fins 14*a* to the space in the (not-shown) casing of the personal computer.

On the other hand, the working fluid 13 having condensed to wet the wall face of the radiating portion 12*a* will drop onto the wall face of the heating portion 12*a* or flow on the inner faces of the individual sloped side wall portions 12*c* until it returns to the heating portion 12*a*. Since the sloped side wall portions 12*c* joint all the individual four sides of the radiating portion 12*b* and the heating portion 12*a*, as described above, the working fluid 13 returned in such all directions to the upper face of the heating portion 12*a* as to concentrate thereon. This causes the evaporation/condensation cycle of the working fluid 13 actively.

Thus, the heat pipe 11 is made wider (e.g., by four times) at its radiating portion 12*b* than at its heating portion 12*a* so that it can condense more vapor to have a higher heat transfer capacity. As a result, the heat pipe 11 can exhibit an excellent cooling capacity for the much heat generated by the CPU 16 thereby to prevent the overheat of the CPU 16 reliably.

Incidentally, the foregoing embodiment has been described on the case in which the heating portion 12*a* and the radiating portion 12*b* are made flat. Despite this description, however, the inner face of the heating portion 12*a* can be roughed to induce the nuclear boiling, and the inner face of the radiating portion 12*b* can also be roughed to promote the dropping of the working fluid.

Figure 6:
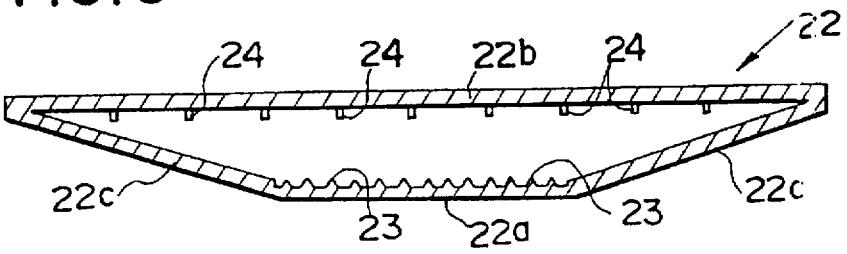
FIG. 6 is a schematic section showing an example of a container having a notched inner face.

This modification of construction will be described more specifically. As shown in FIG. 6, for example, a heating portion 22*a* of a container 22 is formed in its inner face with a number of pointed teeth 23 having a shape of quadrangular pyramid. These pointed teeth 23 are made by forming grooves having a V-shaped section in two orthogonal directions and at a small gap in the wall face of the heating portion 22*a*. The pointed teeth 23 transit the heated state of the working fluid 13 quickly from a non-boiling region to the nuclear boiling region when the heating portion 22*a* is heated to have its heat transferred to the working fluid 13. In other words, the pointed teeth 23 act to prevent the transfer to the film boiling region, when the amount of the working fluid 13 on the surface of the heating portion 22*a* decreases, thereby to continue the nuclear boiling of high heat transfer efficiency.

On the other hand, an overlying wider radiating portion 22*b* is formed on its inner face with a plurality of low ribs 24 which are arranged in parallel and at a sufficient spacing from each other. These ribs 24 adsorb and collect the droplets of vapor, which is condensed to wet the inner face of the radiating portion 22*b* as its heat is transferred to the same portion 22*b*, so that the droplets may grow to drop by the gravity. This construction will prevent the area of the radiating portion 22*b* to contact the vapor of the working fluid 13 from being covered to decrease with the working fluid 13 in liquid phase.

Figure 7:
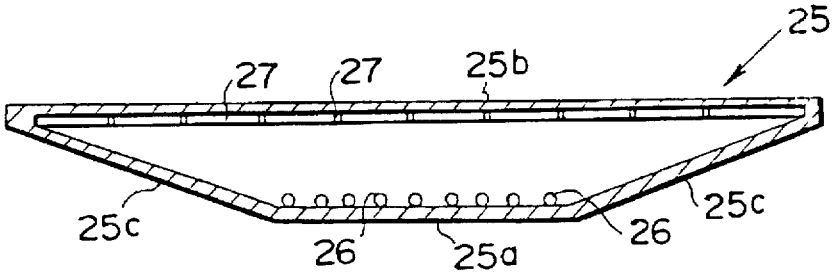
FIG. 7 is a schematic section showing another example of the container having a notched inner face.

On the other hand, FIG. 7 is a longitudinal section of another container, in which the roughed shape for inducing the nuclear boiling and the roughed shape for promoting the dropping of the working fluid 13 are difference from those of the foregoing example. In a metallic container 25, there are formed on the inner face of a heating portion 25*a* a number of small metal balls 26 which are sintered of copper in the roughed shape for causing the nuclear boiling. These numerous small metal balls 26 perform actions similar to those of the pointed teeth 23 of the example shown in FIG. 6. Specifically, at the time of the heat transfer to the working fluid 13 from the heating portion 25*a*, the small metal balls 26 act to continue the nuclear boiling of high heat transfer efficiency by transiting the working fluid 13 quickly from the non-boiling region to the nuclear boiling region and by prevent the transition to the film boiling region when the amount of the working fluid 13 on the surface of the heating portion 25*a* decreases.

On the inner face of a radiating portion 25*b*, on the other hand, there are formed in a lattice shape low ribs 27 which perform actions similar to those of the ribs 24 of the example, as shown in FIG. 6, to facilitate the dropping of the droplets of the working fluid 13, as having condensed on the inner face of the radiating portion 25*b*.

Figure 8:
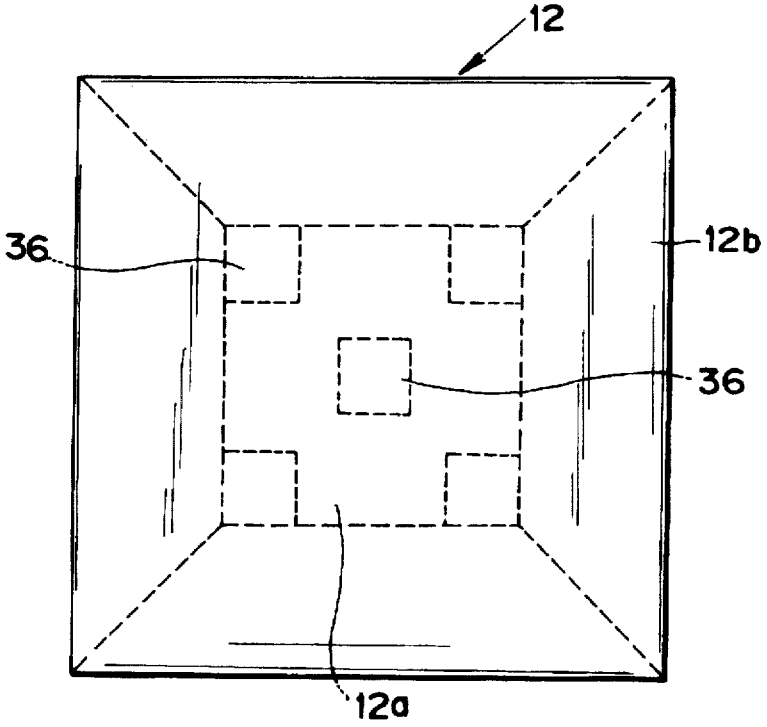
FIG. 8 is a top plan view showing a container having spacer wicks.
Figure 9:
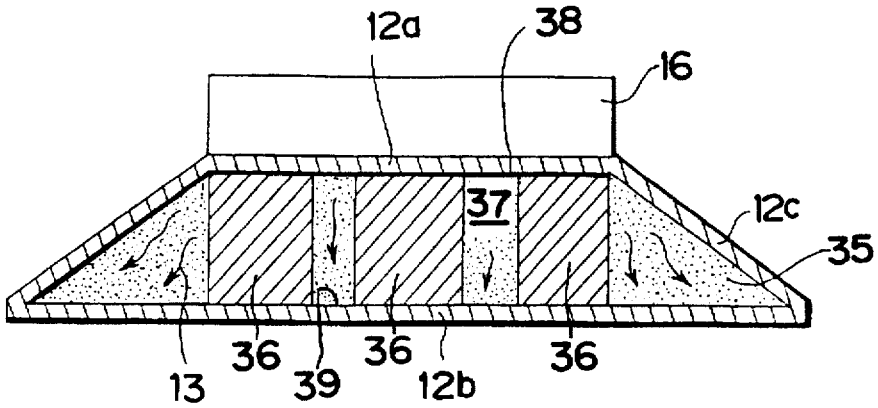
FIG. 9 is a schematic section showing a heat pipe in a top heat mode.

Next, an example, as enabled to perform the operations satisfactorily in the top heat mode, will be described with reference to FIGS. 8 and 9. As shown, the container 12 of the heat pipe is arranged such that the radiating portion 12*b* is positioned below the heating portion 12*a*, that is, with the heat pipe 11 of FIG. 1 being inverted upside-down. And, the CPU 16 is mounted by suitable means on the outer face of the heating portion 12*a*. Moreover, this heat pipe is mounted on the circuit board by the not-shown holder.

On the inner wall faces of the container 12 having a generally quadrangular pyramid shape, there is formed all over a spray coating 35 having a predetermined thickness. This spray coating 35 is given a porous structure having pores between particles by setting the spraying conditions suitably. As a result, the spray coating 35 establishes a capillarity pressure. The material to be sprayed here may be any of ceramics, metals or their mixed thermets and may preferably be exemplified by that which is excellent in heat conductivity and resistance but will not dissolve even after it contacts the working fluid for a long time. Incidentally, the spraying method to be adopted can be exemplified by the method known in the art, such as the plasma spray coating method, the gas spray coating method or the arc spray coating method.

Moreover, the container 12 is equipped in its inside with a plurality of spacer wicks 36 which are made of a sintered metal and worked into blocks having a shape of quadrangular prism. Totally five spacer wicks 36 are so arranged on the face of the heating portion 12*a* at the four corners and at the center that they are sandwiched between the inner faces of the heating portion 12*a* and the radiating portion 12*b*. As a result, the individual spacer wicks 36 are caused by the capillarity pressure to act as the liquid passages for conveying the working fluid 13 in liquid phase from the heating portion 12*a* to the radiating portion 12*b* or from the radiating portion 12*b* to the heating portion 12*a*. On the other hand, cavities 37, as left between the spacer wicks 36, act as vapor passages.

Incidentally, the sintered metal for making the spacer wicks 36 can be replaced by any of a material for establishing the capillarity pressure, such as laminated wire nets, punching metals, foamed metals, porous ceramic blocks, unwoven fabrics or circular cylinders having grooved outer circumferences. The material to be used for the spacer wicks 36 may preferably have a high compressive strength.

While the heat pipe is inactive, therefore, most of the working fluid 13, as contained in liquid phase in the container 12, is sucked by the capillarity pressure of the individual spacer wicks 36 from the inner face of the radiating portion 12*b* and held in the spacer wicks 36 so that it is spread and held all over the inner face of the heating portion 12*a* by the capillarity pressure of the spray coating 35.

When the CPU 16 generates heat in this state, this heat is transferred to the heating portion 12*a* to evaporate the working fluid 13. In the shown example, therefore, the inner face of the heating portion 12*a* acts as an evaporating portion 38 as in the foregoing embodiment. The vapor of the working fluid 13 flows downward to the radiating portion 12*b* through the cavities 37 until it is cooled to condense by the inner face of the radiating portion 12*b*. As a result, the inner face of the heating portion 12*a* acts as a condensing portion 39 of the container 12. The heat of the CPU 16 thus transferred to the radiating portion 12*b* is evolved into the casing of the personal computer from the outer face of the radiating portion 12*b*. As a result, the CPU 16 is cooled down.

On the other hand, the working fluid 13 having restored the liquid phase is sucked to the lower end portions of the individual spacer wicks 36 through the spray coating 35 formed on the inner face of the radiating portion 12*b* so that it is fed to the inner face of the heating portion 12*a* by the capillarity pressures of the individual spacer wicks 36. In short, the working fluid 13 is conveyed to the inner face of the heating portion 12*a* not through the inner faces of the sloped side wall portions 12*c*.

The working fluid 13 is then sucked up from the upper end faces of the individual spacer wicks 36 by the capillarity pressure of the spray coating 35 and is distributed all over the evaporating portion 38. In this meanwhile, however, the working fluid 13 in liquid phase is held by the spray coating 35 so that it does not drop from the inner face of the heating portion 12*a*. The working fluid 13 thus fed to the evaporating portion 38 is heated again to evaporate so that it comes into a cycle similar to the aforementioned one.

Thus, the working fluid 13 in liquid phase can be directly fed from the condensing portion 39 to the evaporating portion 38 which are vertically opposed to each other. In this case, the evaporating portion 38 has an effectively wide area, and the condensed working fluid 13 is quickly fed to the spacer wicks 36. As a result, the heat transfer can be made excellent even in the top heat mode to cool down the CPU 16. In other words, the structure described above can be applied in any operation mode including the sloped position to the cooling operation of the CPU 16. Moreover, the heating portion 12*a* and the radiating portion 12*b* are supported from their inner sides by the spacer wicks 36 so that the container 12 can be freed from any deformation even if the heat pipe is left inactive to establish a high internal vacuum.

Figure 10:
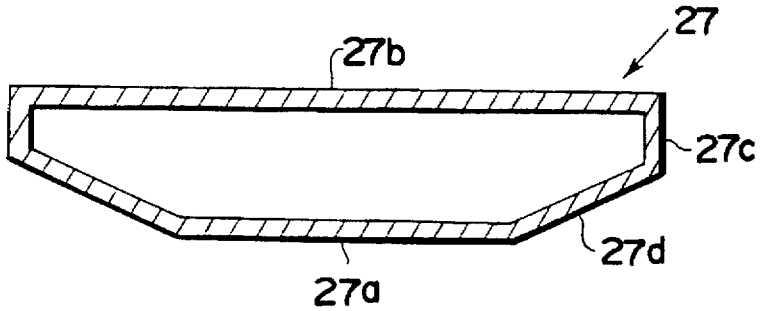
FIG. 10 is a schematic section showing another shape of the container.

The foregoing individual embodiments have been described on the case in which the container 12 of the heat pipe 11 has a flattened quadrangular pyramid shape, but the container may take another shape. The container 27, as shown in FIG. 10, is formed to have a generally pentagonal section by jointing a heating portion 27*a* of a smaller square and a radiating portion 27*b* of a larger square by vertical side walls 27*c* and sloped side walls 27*d* extending from the vertical side walls 27*c*.

Figure 11:
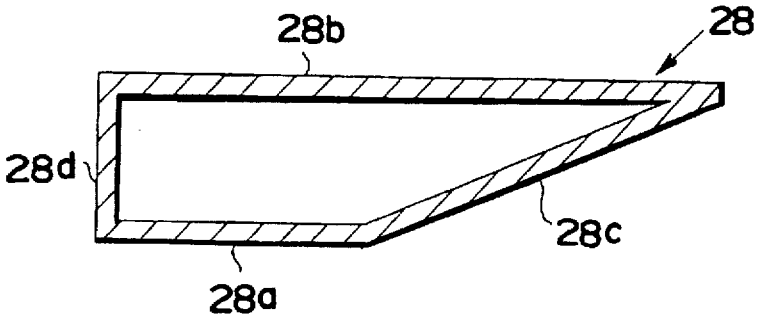
FIG. 11 is a schematic section showing still another shape of the container.

On the other hand, a container 28, as shown in FIG. 11, is given a structure in which a lower heating portion 28*a* is offset from the center of an upper radiating portion 28*b*. The heat pipe thus constructed can be placed without any interference with the surround parts even when the upper space of the CPU 16 mounted in the personal computer is so narrowed as to leave a space only in a limited direction.

Figure 12:
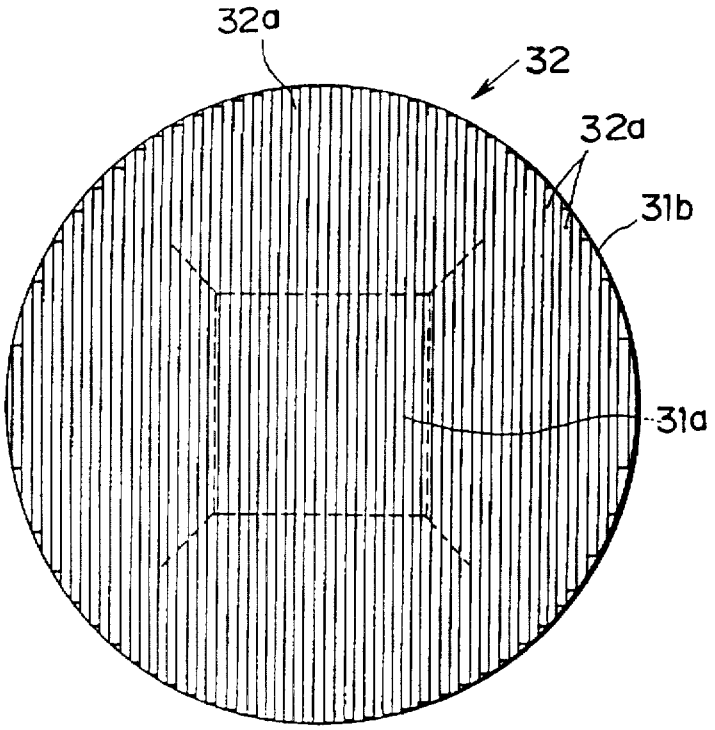
FIG. 12 is a top plan view showing a heat pipe having a circular radiating portion and a heat sink mounted on the heat pipe.
Figure 13:
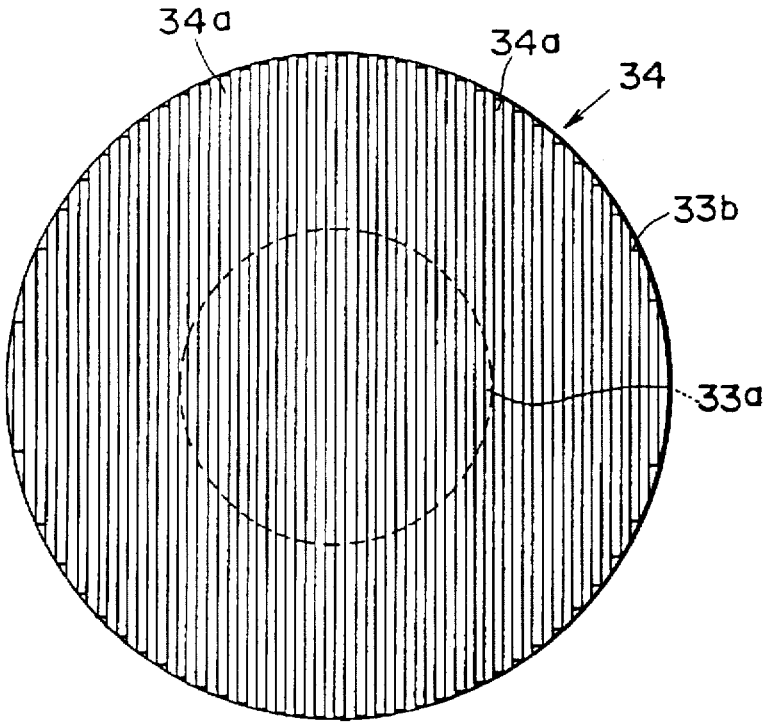
FIG. 13 is a top plan view showing another example of the heat pipe having a circular radiating portion.

In the foregoing embodiments, moreover, the heating portion 12*a* of the heat pipe 11 is given substantially the same shape and size as those of the upper face of the CPU 16, and the radiating portion 12*b* is given shapes and sizes enlarged similarly to those of the heating portion 12*a*. In the present invention, however, a radiating portion 31*b* can be formed into a circular shape, as shown in FIG. 12, against a square heating portion 31*a*. In this case, the shape of a heat sink 32 to be mounted on the radiating portion 31*b* is formed into a circle after the radiating portion 31*b*. Radiating fins 32*a* are arrayed on the heat sink 32. As shown in FIG. 13, moreover, a heating portion 33*a* and a radiating portion 33*b* can be formed into circles having different diameters to form a heat sink 34 into a frustum of circular cone. Incidentally, reference characters 34*a* designate radiating fins.

Figure 14:
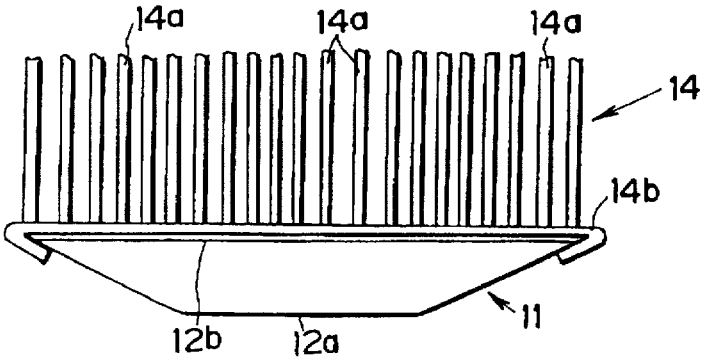
FIG. 14 is a front portion of the state in which the heat sink is mounted on the heat pipe.

Here will be described a method of mounting the heat sink 14 on the heat pipe 11. As shown in FIG. 14, the base plate 14*b*, which is made of an aluminum plate and having the numerous radiating fins 14*a* at the predetermined pitch, is placed in close contact on the upper face of the radiating portion 12b of the heat pipe 11. In this state, at least two opposed side edges of the base plate 14b are folded downward to clamp the edges of the radiating portion 12b of the heat pipe 11. As a result, the heat, as transferred to the radiating portion 12b of the heat pipe 11, is efficiently transferred to the individual radiating fins 14a through the base plate 14b.

Figure 15:
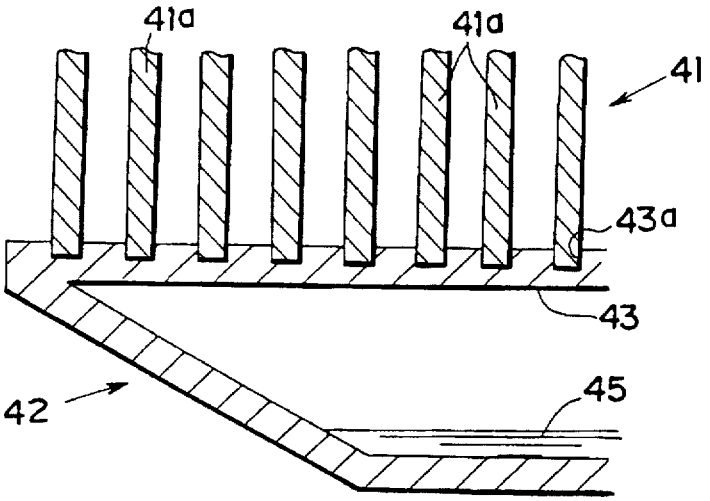
FIG. 15 is a front elevation showing a portion of another example of the state in which the heat sink is mounted on the heat pipe.

Another method of mounting the heat sink will be described in the following. As shown in FIG. 15, for example, fitting grooves 43a for fitting the individual lower sides of a number of thin radiating fins 41a of aluminum for a heat sink 41 are formed at a predetermined pitch in the upper face of a radiating portion 43 of a heat pipe 42. The lower portions of the radiating fins 41a are fitted in the individual fitting grooves 43a, and the 1 and portions of the upper face of the radiating portion 43 between the individual fitting grooves 43a are caulked to reduce the widths of the fitting grooves 43a, or the individual radiating fins 41a are forced downward and thickened in the fitting grooves 43a. Thus, the heat, as transferred to the radiating portion 43 of the heat pipe 42, is transferred directly to the individual radiating fins 41a. Incidentally, reference numeral 45 designates a working fluid.

Figure 16:
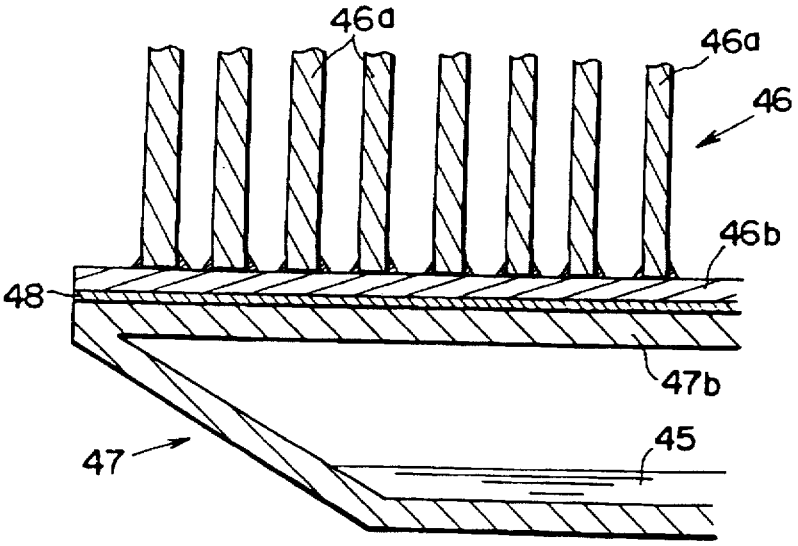
FIG. 16 is a front elevation showing a portion of still another example of the state in which the heat sink is mounted on the heat pipe.

Still another method of mounting the heat sink will be described with reference to FIG. 16. A heat sink 46 is prepared by welding a number of radiating fins 46a at a predetermined pitch to a base plate 46b made of an aluminum plate. The heat sink 46 thus prepared is mounted on a heat pipe 47 by adhering the lower face of its base plate 46b to the upper face of a radiating portion 47b of the heat pipe 47 by a thermal joint (or an adhesive containing metal powder) 48.

As a result, the heat, as transferred to the radiating portion 47b of the heat pipe 47, is efficiently transferred to the individual radiating fins 41a through the base plate 46b.

Figure 17:
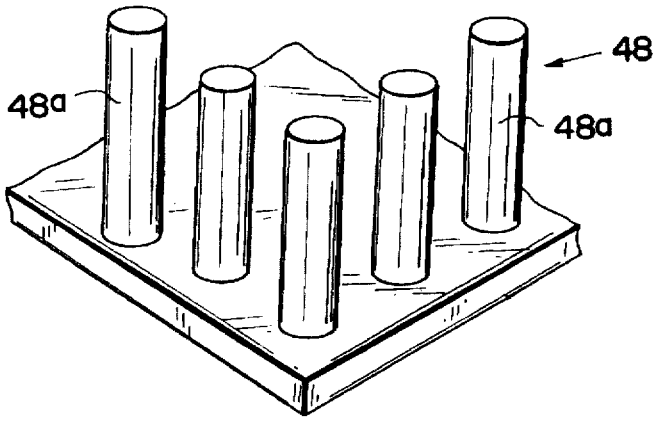
FIG. 17 is a perspective view showing a portion of a heat sink which is provided with a number of radiating pins.

Although the foregoing embodiments have been described on the case in which the radiating fins used are the flat ones 14a, 41a and 46a of aluminum, these fins should not be limited to the aluminum ones but may be made of a metal having an excellent heat conductivity such as a copper plate. As shown in FIG. 17, moreover, the heat sink 48 can also be made by anchoring a number of radiating pins 48a of copper.

Figure 18:
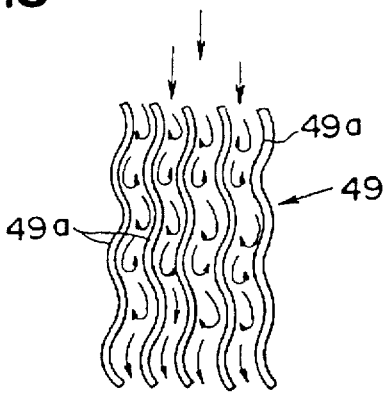
FIG. 18 is a top plan view schematically showing a heat sink which is provided with corrugated radiating fins.
Figure 19:
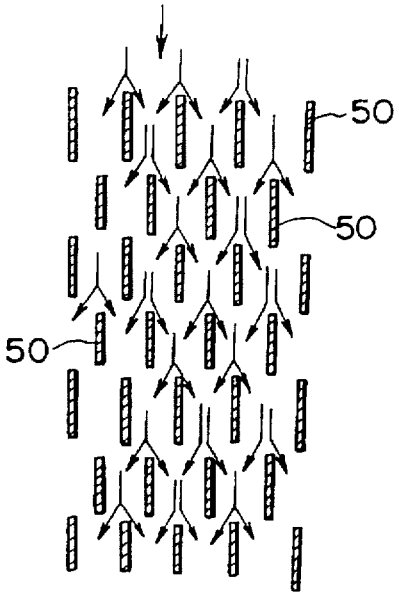
FIG. 19 is a top plan view schematically showing a heat sink which is provided with staggered slit fins.

According to another shape of radiating fins, corrugated radiating fins 49a may be arranged at a predetermined pitch on a heat sink 49, as shown in FIG. 18. With this arrangement, the air to flow through the gaps between the radiating fins 49a can swirl in a turbulent state to provide an excellent radiation As shown in FIG. 19, moreover, a number of short radiating fins 50 are staggered in parallel with the air flow direction. With this arrangement, an excellent radiation performance is also achieved by the cooling effect, i.e., the leading edge effect which is caused when the wind directly collides against the leading edges of the individual radiating fins 50.

Figure 20:
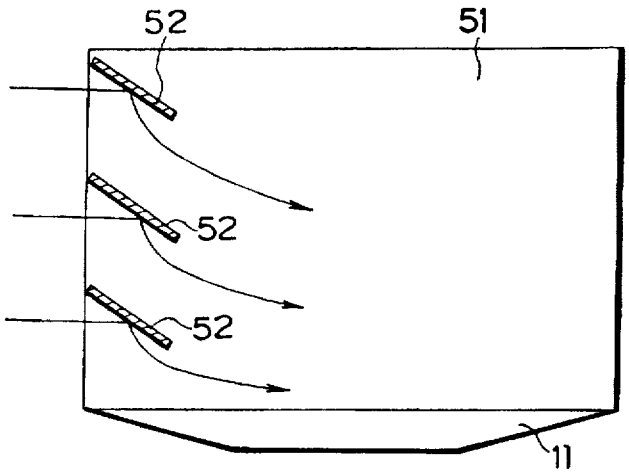
FIG. 20 is a side elevation of a radiating fin which is equipped with flat-shaped guide plates.

In the present invention, moreover, the current plates 18 may be replaced by three steps of flap- shaped guide plates 52 which are formed on each radiating fin 51 at the air inlet side of air passage gaps for guiding the incoming air downward, as shown in FIG. 20. With this construction, the air is guided along the lower portions of the individual radiating fins 51 so that the radiation efficiency is enhanced. Moreover, this obliquely downward flow of air can prevent the separation of the laminar flow of air along the upper face of the radiating portion 11b of the heat pipe 11 so that the flow rate of air can be increased to enhance the radiation efficiency better.

Figure 21:
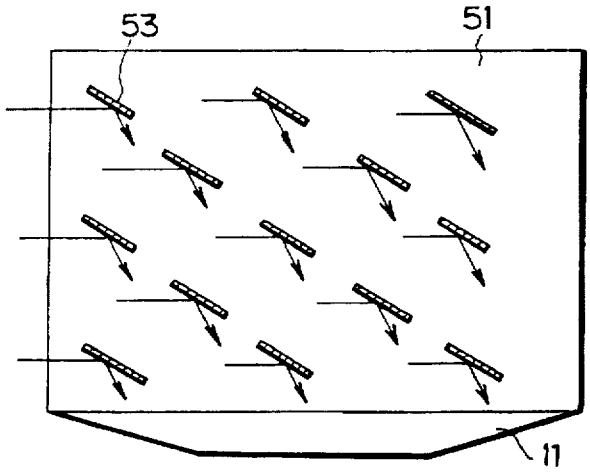
FIG. 21 is a side elevation of a radiating fin which is equipped with a number of baffle plates.
Figure 22:
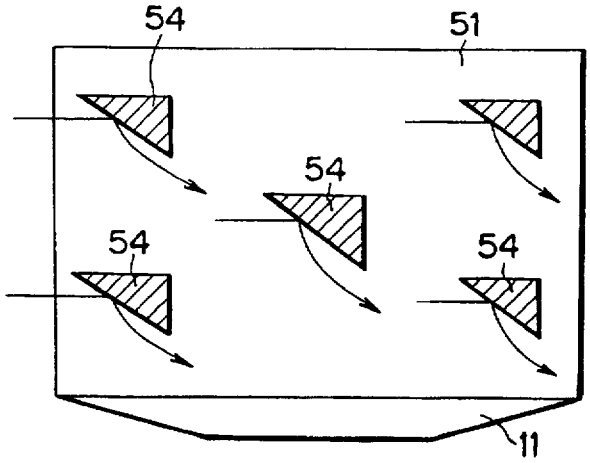
FIG. 22 is a side elevation of a radiating fin which is equipped with guides made of a rectangular- triangle sheet.

In the present invention, still moreover, the flap-shaped guide plates 52, as shown in FIG. 20, may be replaced by a number of baffle plates 53 which are so formed between the individual radiating fins 51 as to have their downstream sides in an obliquely downward direction, as shown in FIG. 21. With this construction, too, it is possible to achieve effects similar to those of the guide plates 52. As shown in FIG. 22, furthermore, the baffle plates 53 may be replaced by triangular prisms 54 which are arranged between the individual radiating fins 51 and formed of a thin sheet into a right-angled triangle such that their oblique sides are directed downward. This construction can also provide similar effects.

Incidentally, the foregoing embodiments have been described on the case in which the heat pipe 11 of the present invention is used for cooling the CPU 16 of the personal computer. Despite of this description, however, the present invention should not be limited to those embodiments but can be applied for cooling electronic elements such as power transistors.

Figure 23:
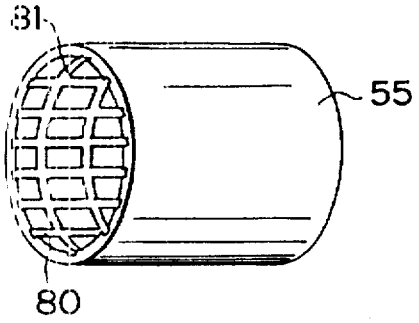
FIG. 23 is a perspective view showing a pipe having a grooved inner face.

Here will be described a method of manufacturing the heat pipe 11 having the construction thus far described. Incidentally, the same reference numerals will be attached to the parts which have already been described, and the detailed description of the parts will be omitted. First of all, as a material for the container 12, there is prepared a metal pipe having a circular section such as a copper pipe 55, which has been cut in advance to a predetermined size. As shown in FIG. 23, the inner wall face of this pipe 55 is formed to have a plurality of linear grooves 80 extending in the longitudinal direction and a plurality of annular grooves 81 extending in the circumferential direction. Incidentally, these grooves 80 and 81 provide ridges for inducing the nuclear boiling and ridges for promoting the dropping of the working fluid, respectively.

Figure 24:
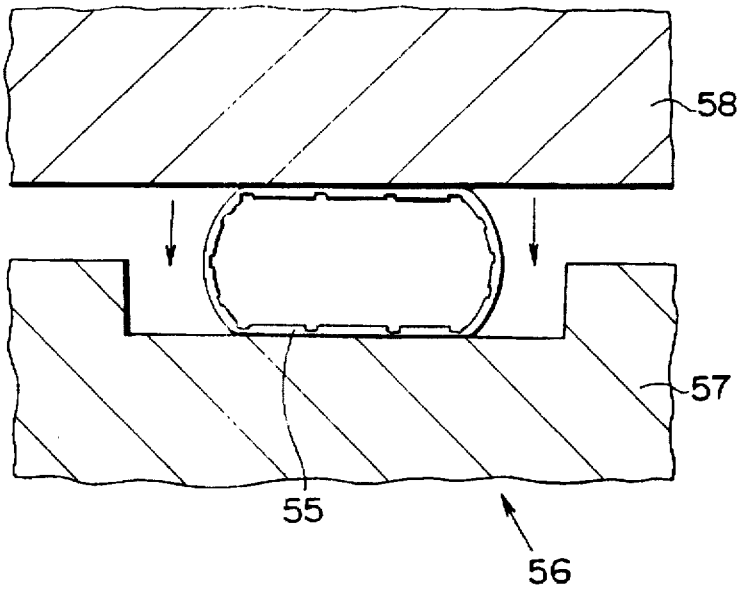
FIG. 24 is a schematic diagram showing a forming mold and a pipe being crushed.

Next, the pipe 55 thus grooved is worked into a flattened hollow shape. FIG. 24 shows a schematic construction of a press 56 for the working facilities. The die (or forming mold) of the press is constructed to include: a lower mold which is as deep as the thickness of the flattened shape to be formed; and a punch 58 to be moved downward to close the opening of the lower mold 57. Specifically, the bottom face in the recess of the lower mold 57 and the lower face of the punch 58 provide the molding faces for clamping and pressing the pipe 55, and these molding faces are flat and parallel to each other.

Figure 25:
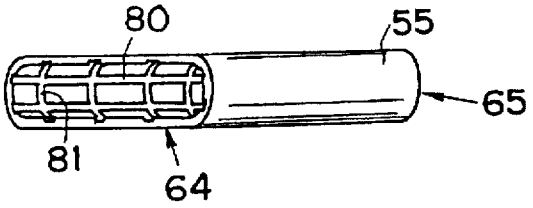
FIG. 25 is a perspective view showing the pipe which is crushed into a flattened hollow shape.

For working the pipe 55 into the flattened hollow shape by the pressure 56 thus constructed, the pipe 55 is inserted at first into the clearance between the lower mold 57 and the punch 58. When this punch 58 is moved downward, its lower face comes into the upper face of the pipe 55. As the punch 58 is further moved downward, the pipe 55 is deformed from the shape of an elliptical section into a flattened shape. When the punch 58 is moved downward to its lower limit, the pipe 55 is molded or pressed into the shape, as shown in FIG. 25.

Next, the inner face of the flattened pipe 55 is degreased and washed. As this washing means, there can be adopted the known means such as the washing means using a suitable solvent or the ultrasonic washing means.

Figure 26:
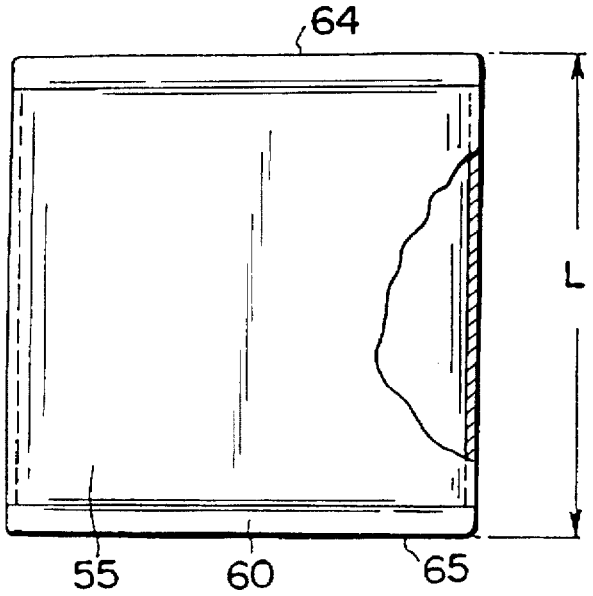
FIG. 26 is a schematic top plan view showing the state in which the open ends of a pipe are crushed.

Next, one open end 64 of the flattened pipe 5 is sealed. For example, the edge portion of the pipe 55 is crushed in the depthwise direction all over its width W. Here, the width of the crushed portion, as taken in the direction of length L, is as small as about several millimeters (as shown in FIG. 26). Moreover, the edge portions of the inner circumference of the pipe 55 are closely caulked substantially at their depthwise center. Incidentally, this crushing step can adopt the press or jig known in the art.

Figure 27:
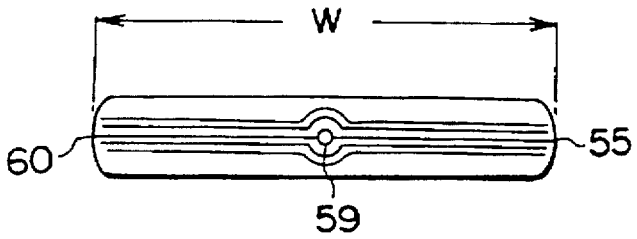
FIG. 27 is a schematic front elevation of the pipe.

At the other open end 65 of the pipe 55, too, the edge portions of the inner circumference of the pipe 55 are closely caulked substantially at their depthwise center, but the center, as taken in the direction of the width W, of this end portion is not caulked to form an opening 59 (as shown in FIG. 27) for receiving an injection nozzle 61 to provide communication with the internal space. In order to form the opening 59 for the inlet of the working liquid, there is used a forming mold in which the forming faces of the upper and lower molds are recessed in positions to correspond to the opening 59.

Figure 28:
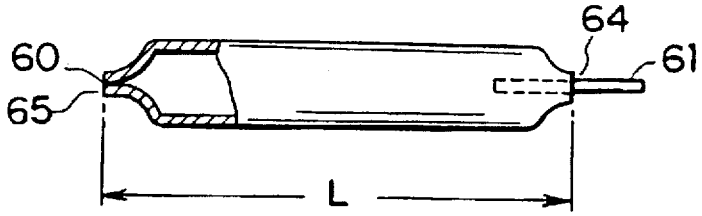
FIG. 28 is a schematic diagram showing the pipe to which is attached an injection nozzle.

Next, both the open ends 64 and 65 of the pipe 55 are sealed up by welding their joint portion 60, for example. At this time, one end portion of the injection nozzle 61 is inserted into the opening 59 and is fixed by the welding or soldering means (as shown in FIG. 28). Here, the injection nozzle 61 is exemplified by a pipe which is made of the same material as that of the pipe 55 to have a circular section of smaller diameter. For sealing the open ends 64 and 65, there can be enumerated another method of welding an elliptical end plate having substantially the same sectional shape as that of the pipe 55 to the open ends 64 and 65.

Figure 29:
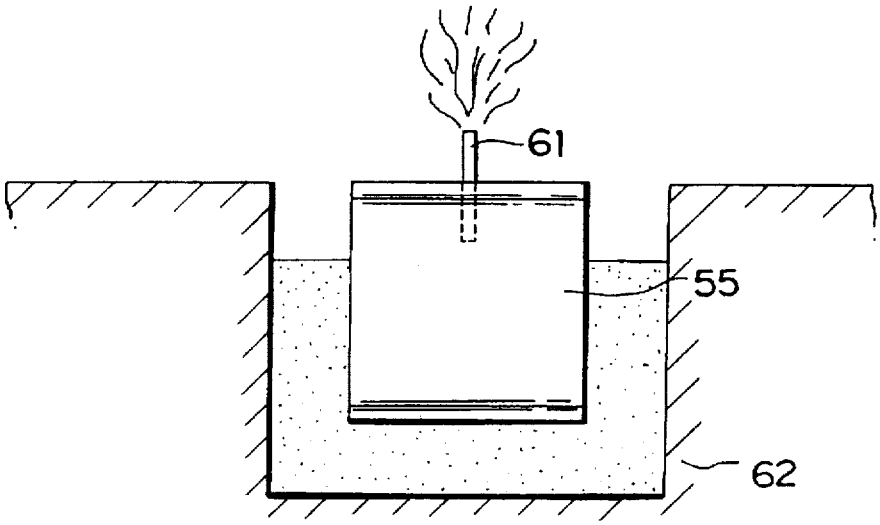
FIG. 29 is a schematic diagram showing a heating/expelling step.

Next, the pipe 55 is made into the heat pipe. Specifically, the working fluid or pure water is injected slightly more than a specified amount into the pipe 55 through the injection nozzle 61. This expels the non-condensable gas out of the pipe 55 at the next step. This is exemplified by the heating/expelling step, as follows. The pipe 55 is placed in a silicone oil bath 62 such that its end portion having the injection nozzle 151 is in the upper position, as shown in FIG. 29, and is heated to about 120° C. Then, the non-condensable gas, as dissolved in the working fluid, is released together with the vapor of the working fluid from the open end of the injection nozzle 151 to the outside of the pipe 55. In other words, the amount of the working fluid to be substantially confined is the subtraction of the amount of the released vapor from the total of the working fluid which has been confined in advance in the pipe 55. After the predetermined amount of vapor has been expelled, the leading end of the injection nozzle 61 is crushed so that it is temporarily sealed. As a result, the pipe 55 thus sufficiently degassed presents the container 12 of the heat pipe 11. Incidentally, at this heating/expelling step, there can also be adopted a method, in which the internal pressure of the pipe 55 is raised with the injection nozzle 61 being temporarily fastened, so that the working fluid is then flashed by opening the temporarily fastened portion. Incidentally, this embodiment is embodied by the heating/expelling method for degassing/confining the working fluid in the container 12, but this method can be replaced by the vacuum pump method or the gas liquefying method.

Figure 30:
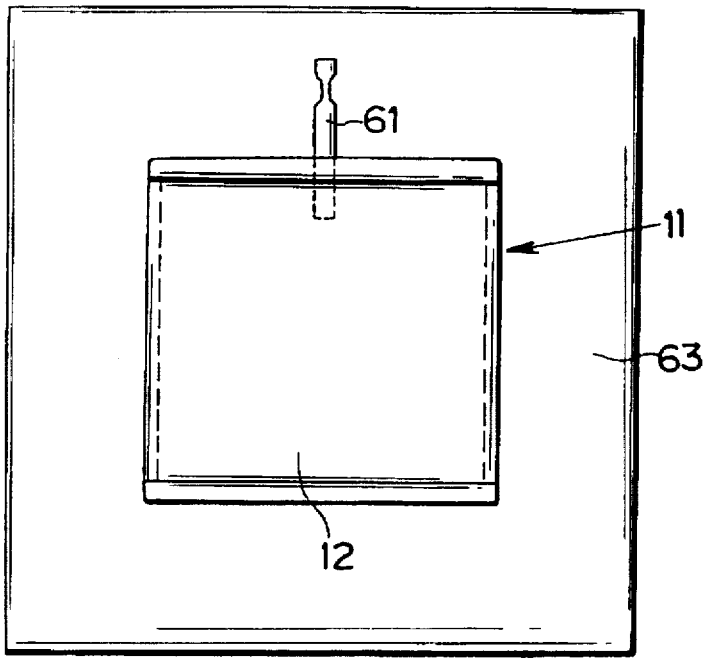
FIG. 30 is a schematic diagram showing a seasoning step.

Next, the heat pipe 11 is seasoned. This seasoning step is conducted to enhance the reliability of the heat pipe 11, as well known in the art, by discovering fine pin holes or by improving the wetting properties between the inner wall face of the pipe 55 (or container 12) and the working fluid. At this step, as shown in FIG. 30, the heat pipe 11 is accommodated in a heating furnace such as a batch furnace or tubular furnace 63 and is continuously heated at about 100° C. for a predetermined time period. After this step, the heat pipe 11 is opened by cutting the temporarily sealed portion of the injection nozzle 61, and the working fluid as confined is disposed of. Incidentally, a foreign substance such as the scale is removed, if any in the container 12, together with the working fluid to the outside of the container 12. Thus, the seasoning step described above functions as a second washing step of washing the inside of the pipe 55 at the second time.

Figure 31:
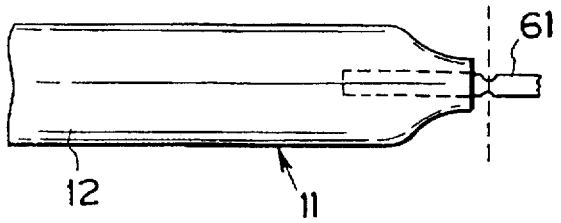
FIG. 31 is a schematic diagram showing a proper step of sealing the injection nozzle.

Next, pure water is newly injected slightly more than the specified amount into the emptied pipe 55 (or container 12). A heating/expelling operation like the aforementioned one is executed again to expel the non- condensable gas, as dissolved in the working fluid, out of the pipe 55. After this, the injection nozzle 61 is permanently sealed at its root end portion near the end portion of the pipe 55 (as shown in FIG. 31). Incidentally, this sealed portion is welded, if necessary.

Figure 32:
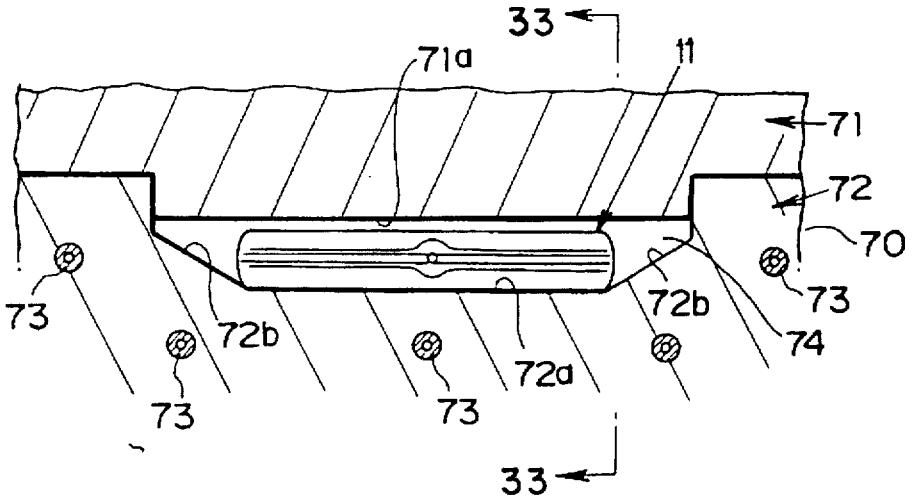
FIG. 32 is a schematic diagram showing a step of forming a container.
Figure 33:
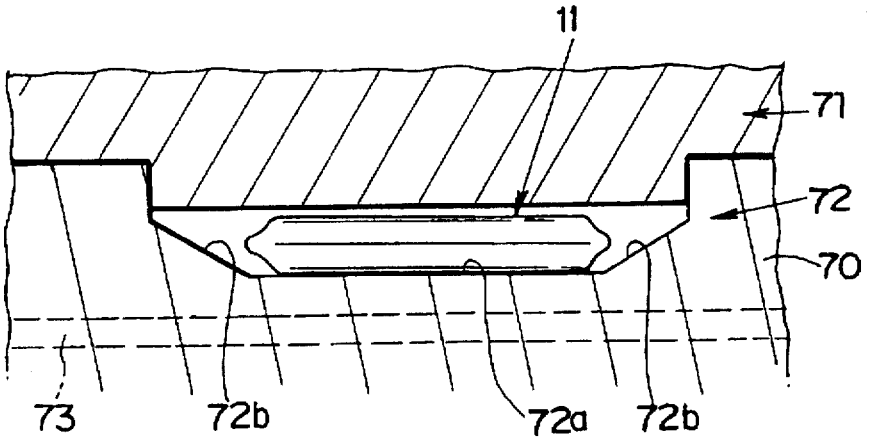
FIG. 33 is a section taken along line A—A of FIG. 32.
Figure 34:
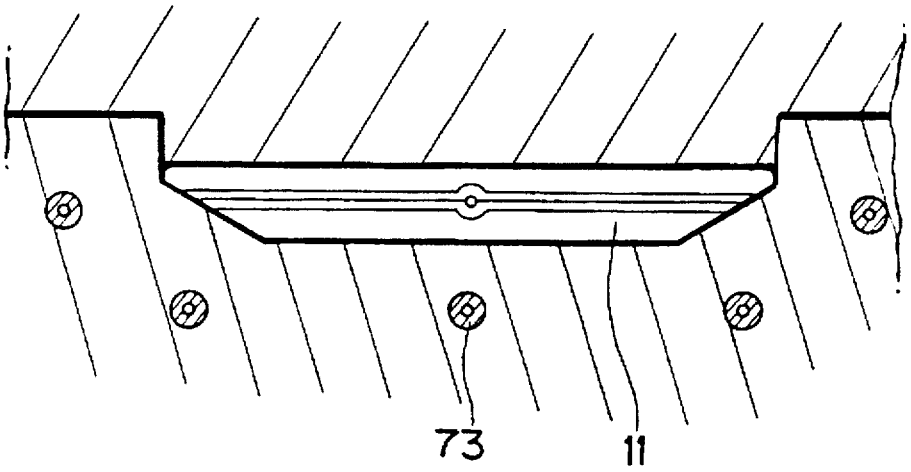
FIG. 34 is a schematic diagram showing the state in which the container of a heat pipe is expanded.
Figure 35:
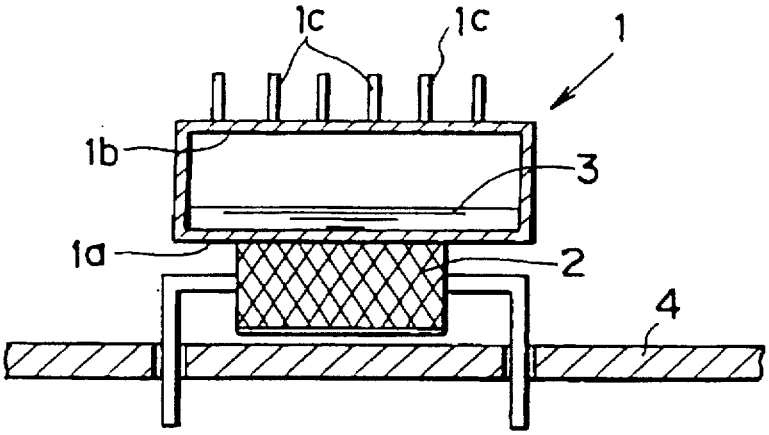
FIG. 35 PRIOR ART
FIG. 35 is a diagram showing one example of the flat heat pipe of the prior art.

Next, the container 12 is formed, as shown in FIGS. 32 and 34. A forming mold 70, as shown, is constructed of an upper mold 71 and a lower mold 72. This lower mold 72 is provided with bottom face 72*a* for forming the heating portion 12*a* of the heat pipe 11 and sloped faces 72*b* (of which only two faces are shown) expanding upward from the four sides of the bottom face 72*a* for forming the sloped side walls 12*c* of the heat pipe 11. In this lower mold 72, there are mounted a plurality of heaters 73 which are positioned close to the bottom face 72*a* and the sloped faces 72*b*. These heaters 73 can be thermally controlled to have different temperatures.

On the other hand, the upper mold 71 is provided with an upper face 71*a* for forming the radiating portion 12*b* of the heat pipe 11. Specifically, the upper mold 71 closes the upper opening of the lower mold 72 to define a cavity 74 substantially having a frustum of quadrangular pyramid in the shaping mold 70.

In order to form the container 12 by the shaping mold 70 described above, the flattened heat pipe 11 is accommodated in the cavity 74 of the forming mold 70. In this state, the individual heaters 73 are energized to heat the lower mold 72 continuously for a predetermined period at a temperature of about 150° to 200° C. As a result, the working fluid evaporates in the container 12. In this case, the container 12 is continuously heated in its entirety so that the internal pressure of the heat pipe 11 is held at a high level. As this internal pressure is sufficiently elevated by raising the heating temperature of the heat pipe 11, the container 12 starts to be plastically deformed in all directions from its inside. In other words, the container 12 starts to expand in its entire region.

Since the heat pipe 11 is regulated therearound by the upper mold 71 and the lower mold 72, as described above, the container 12 continues to expand until its outer wall face comes into contact with the bottom face 72*a*, the sloped faces 72*b* and the upper face 71*a*. As the expansion of the container 12 further advances from that state, the outer wall face of the container 12 is forced onto those bottom face 72*a* and sloped faces 72*b* until the container of the heat pipe is formed into the frustum of quadrangular pyramid profiling the cavity 74.

When this heat pipe 11 is slowly cooled, the container 12 is sufficiently annealed to have a surface in an excellent status with neither wrinkles nor cracks. Incidentally, this forming step may be divided into several times and repeated at the several times.

Next, the heat pipe is conveyed to the not- shown thermal property testing step, at which it is tested as to its heat transfer, thermal uniformity and so on. As to the heat pipe 11 conforming to the test standards, the outer surface of the container 12 is coated with nickel, for example, and is implanted on the upper face of the container 12, as shown in FIG. 4, with the radiating fins 14*a* which have been prepared at the different step. Incidentally, these mounting means have been described hereinbefore. Although not especially shown, the heat pipe 11, as equipped with the radiating fins 14*a*, is then conveyed to the final testing step, at which it is tested as to its appearance, size, weight and heat transfer properties. At this stage, all the steps of the process are finished.

What is claimed is:

1. A heat pipe for a working fluid to transfer heat in the form of latent heat of evaporation, comprising a flattened hollow container formed generally into a hollow frustum of a quadrangular pyramid and confining said working fluid, wherein said container includes:

a flat heating portion;

a flat radiating portion opposed at a distance to said heating portion and having a larger area than that of said heating portion; and side wall portions joining said heating portion and said radiating portion to each other, said side wall portions being tapered along substantially the entire height thereof.

2. A heat pipe according to claim 1, wherein said heating portion is made to have the same shape as that of the surface of a heating member and held in close contact with said heating member.

3. A heat pipe according to claim 1, further comprising a heat sink having a base plate provided with a multiplicity of radiating projections and mounted on said radiating portion.

4. A heat pipe according to claim 3, wherein said radiating projections fins of thin sheet.

5. A heat pipe according to claim 4, further comprising plates mounted between said fins for controlling the flow direction of air between said fins.

6. A heat pipe according to claim 3, wherein said radiating projections have pins.

7. A heat pipe according to claim 3, further comprising a holder for holding and mounting said container and said heat sink on a circuit board.

8. A heat pipe according to claim 1, further comprising a multiplicity of projections formed on the inner face of said heating portion and the inner face of said radiating portion.

9. A heat pipe according to claim 8, wherein the projections on the inner face of said heating portion have sintered balls.

10. A heat pipe according to claim 8, wherein the projections on the inner face of said radiating portion have ribs formed between grooves.

11. The heat pipe of claim 1 wherein said flat radiating portion opposed at a distance to said heating portion has an area at least four times that of said heating portion.

12. The heat pipe of claim 11 including heat radiating fins mounted exteriorly of said heat pipe and substantially only on said radiating portion opposed at a distance to said heating portion.

13. A heat pipe for a working fluid to transfer heat in the form of latent heat of evaporation, comprising a flattened hollow container confining said working fluid, wherein said container includes:

a flat heating portion;

a flat radiating portion opposed at a distance to said heating portion and having a larger area than that of said heating portion;

side wall portions joining said heating portion and said radiating portion to each other, said side wall portions being tapered along substantially the entire height thereof; and heat radiating fins mounted exteriorly of said heat pipe and substantially only on said radiating portion opposed at a distance to said heating portion.

14. A heat pipe for a working fluid to transfer heat in the form of latent heat of evaporation, comprising a flattened hollow container confining said working fluid, wherein said container includes:

a flat heating portion;

a flat radiating portion opposed at a distance to said heating portion and having an area at least four times that of said heating portion; and side wall portions joining said heating portion and said radiating portion to each other, said side wall portions being tapered along substantially the entire height thereof.

* * * * *